United States Patent [19]

Bolton et al.

[11] 4,249,399

[45] Feb. 10, 1981

[54] FABRIC WASHING SYSTEM

[75] Inventors: Joseph A. Bolton, Glens Falls; Olavi A. Huhtala, Scotia, both of N.Y.

[73] Assignee: Albany International Corp., Menands, N.Y.

[21] Appl. No.: 102,151

[22] Filed: Dec. 10, 1979

Related U.S. Application Data

[63] Continuation-in-part of Ser. No. 29,540, Apr. 12, 1979.

[51] Int. Cl.[3] ..... D06B 1/02; D06B 15/00

[52] U.S. Cl. ..... 68/20; 15/306 A; 68/205 R

[58] Field of Search ..... 8/151; 68/20, 205 R; 34/155; 118/50; 15/306 R, 306 A, 307, 321, 322

[56] References Cited

U.S. PATENT DOCUMENTS

| | | | |
|---|---|---|---|
| 883,536 | 3/1908 | Gessner | 15/306 A X |
| 1,750,496 | 3/1930 | Stride | 68/20 |
| 3,919,729 | 11/1975 | Cannan | 15/321 X |
| 3,997,928 | 12/1976 | Leifeld | 68/20 X |

FOREIGN PATENT DOCUMENTS

| | | | |
|---|---|---|---|
| 610500 | 3/1935 | Fed. Rep. of Germany | 8/151 |

*Primary Examiner*—Philip R. Coe

[57] ABSTRACT

An apparatus and system are disclosed for extracting liquid from porous fabrics. The apparatus includes a vacuum source, a back-up plate positioned opposite the vacuum source such that a gap exists therebetween, an adjusting means for setting the minimum size of the gap between the vacuum source and the back-up plate, and a mounting structure to which the back-up plate is secured, the mounting structure allowing the plate to move in a direction away from the vacuum source thereby increasing the size of the gap. In operation, a porous fabric is passed through the gap while the back-up plate floats thereon. The plate is able to bounce over seams or any other irregularities within the fabric.

14 Claims, 5 Drawing Figures

FABRIC WASHING SYSTEM

CROSS-REFERENCE TO RELATED APPLICATION

This application is a continuation-in-part of Ser. No. 29,540, filed Apr. 12, 1979.

BACKGROUND OF THE INVENTION

The field of the invention relates to a system for washing fabrics such as carpets or textiles.

Fabrics have been cleaned by using any one of several techniques. They may be immersed in a wash bath and then dried by using high pressure squeeze rolls, vacuum slots, and drying ovens. Other systems have provided face side washing whereby a shower nozzle and vacuum slot are positioned on one side of the fabric. The backing of the fabric is not wetted in such a system.

The previous best method for removing gums from carpet fiber after steaming to set the dye has been to spray the back of the carpet with hot water and then to vacuum extract from the face side with standard vacuum slots. Other previous methods included the washing of the carpet in hot water with agitation to improve the removal of residuals.

The major disadvantages of these methods has been inadequate removal, particularly of the viscous gums that were used to control the dyes prior to and during the steaming operations. Residual gums present in carpet due to inadequate removal result in higher flammability and greater tendency to soiling of the finished carpet.

U.S. Pat. Nos. 3,922,738 and 3,938,356 are examples of fabric treating devices employing some of the abovementioned techniques. Commonly assigned U.S. Pat. No. 3,836,428 discloses an adjustable slot mounted on a suction pipe for vacuum conditioning felt designs.

SUMMARY OF THE INVENTION

It is an object of the invention to provide a system which provides through fabric washing without the need for immersing it in a wash bath.

Another object of the invention is to direct an air flow through the fabric in the most efficient and energy conserving manner.

Still another object of the invention is to improve the removal of residual gums to provide a cleaner finished carpet with reduced flammability and greater resistance to soiling.

With these and other objectives in mind, a washing system is provided having means by which a fabric is essentially wetted on one side and subjected to vacuum treatment on the other side. The fabric will accordingly be wetted throughout.

A plurality of water sprays are directed at the back side of a carpet into a roll nip to force the water towards the face fibers. As the carpet passes over a suction pipe having one or more slotted openings, it is wet throughout. An air restriction means positioned against or near the back side of the carpet opposite a slotted opening increases the efficiency of the system. A greater drop in pressure across the carpet is provided and the air must flow in a more indirect route. It thereby contacts more of the material surface at a relatively high velocity. Increased dewatering is accordingly provided. In addition, the tufts on the face of the carpet spend more time within the slotted opening and are more effectively cleaned. The air restriction means which backs up the carpet floats thereon during the dewatering operation. It accordingly may bounce over seams or other areas of irregular carpet thickness.

Additional showers and suction pipes may be included within the system if necessary.

DESCRIPTION OF THE INVENTION

The invention is directed to a system for the washing of a fabric such as carpet. In many cases, particularly with unbacked carpet, it is desirable to completely wet a fabric without having to immerse it within a bath. Enough liquid, such as water, should be employed to remove unwanted material from the fabric. However, excessive amounts will necessitate large energy expenditures in the subsequent drying process. A compromise should accordingly be reached between the maximum cleaning effect using large volumes of liquid and maximum dryness of the fabric by employing lesser quantities.

Showers are typically employed for wetting the back side of a carpet. A slotted suction pipe is positioned on the face side thereof to provide vacuum cleaning action. In standard slots, the tuft of the carpet will bend away from the slot as it approaches it. This shortens the exposure time during which each tuft is subject to the vacuum cleaning. The air flow may also be directly through the carpet rather than principally through the pile. The invention provides a means for making most efficient use of the air flow within a fabric cleaning apparatus in terms of both energy consumption and cleaning ability.

Figure 1:
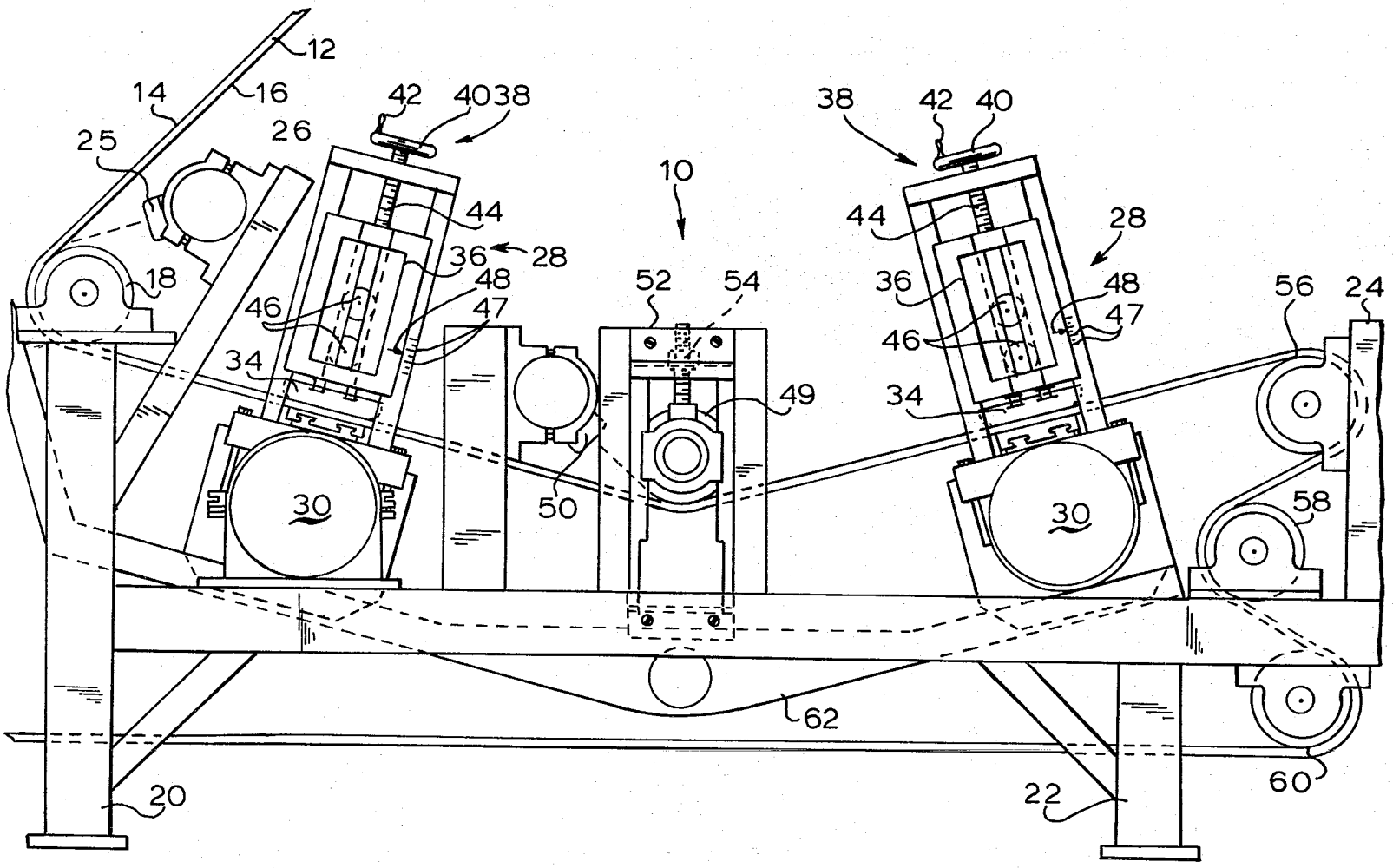
FIG. 1 is a side elevation view of the fabric washing system.

The washing system 10 is shown in its entirety in FIG. 1 as a fabric 12 proceeds from a steamer (not shown) and passes therethrough. In this example the fabric is a carpet having a tufted face fiber 14 of ordinary length and a porous backing 16 of jute or other woven or non-woven material.

The carpet first passes about an idler roll 18 which is supported by one of the legs 20,22 of the mounting assembly 24. Hot water or another appropriate liquid is directed from a first shower 25 nozzle into or before the nip between the carpet and the roller. The pressure is sufficient to wet the backing 16 of the carpet such that water will ooze therethrough. However, it should not be so great that the water blasts completely through. Pressures ranging from ten to eighty psi have been successfully employed with flows for each nozzle between one-half and two and one-half gallons per minute. A plurality of shower nozzles 25 are ordinarily employed for wetting the carpet. Their number depends upon the width of the carpet which is intended to be accommodated by the system. The nozzles 25 are mounted to a bracket 26 which is appropriately shaped for allowing the passage of the carpet 12 therethrough.

The shower nozzles may be spaced between two and four inches apart.

The wet carpet proceeds from the idler roll 18 to a prolix diffuser assembly 28 including a suction pipe 30. The pipe is air tight with the exception of a slotted opening 32 having a width in the range of $\frac{1}{8}$ to $\frac{5}{8}$ inches. A pump or other means (not shown) provides the necessary suction within the pipe. Vacuum levels between five and fifteen inches of mercury have been found to be appropriate for cleaning and drying. Carpet speeds of ten to sixty feet per minute are typically used.

It has been found that with carpeting and textile materials, better dewatering and cleaning can be achieved with a smaller volume of air at higher velocity than larger volumes at a lower velocity. If air is allowed to pass directly through a material such as unbacked carpet or an open woven textile, it will pass through the void areas in the path of least resistance. A lesser amount of water will be picked up from the surface than if an air restriction or backing device is positioned behind the material at such relation to the suction slot 32 to cause the air to flow in a more indirect route. It will thereby contact more of the material surface of the substrate and promote efficient cleaning and drying. A reduced air flow is required and therefore energy requirements are also reduced.

Figure 2:
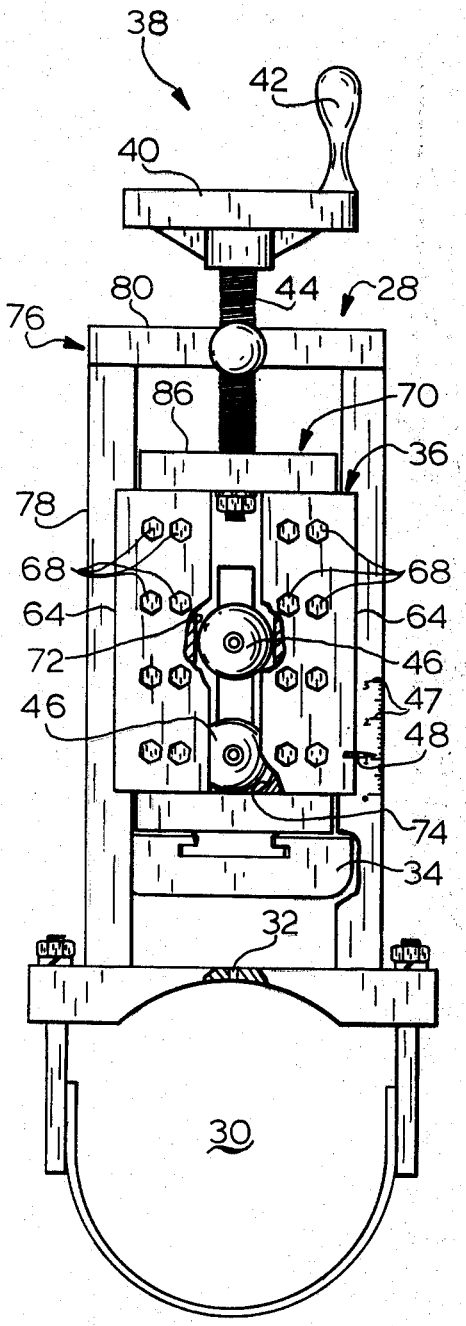
FIG. 2 is an enlarged elevational view of the suction assembly.

The restricting member in FIGS. 1 and 2 is a non-porous plate 34 which floats upon the carpet in a manner explained below, although it may alternatively take other forms. It may require some permeability depending on the nature of the material to be dewatered. Because the materials to be dewatered can vary in weaves, patterns and permeability, it may be necessary to use complex and/or adjustable patterns to direct air flow.

The restricting member not only causes the air to travel an indirect route, but also increases the pressure drop across the fabric. High pressure drop results in higher water removal with lesser expenditures of energy, drier carpets after the suction pipe and higher velocity air flows. The desired air flow for a particular fabric will depend on the permeability of the substrate, the total shower water added, and the dwell time over the suction pipe.

The gap between the backup plate 34 and the slot face 35 is adjustable and must be large enough to permit air flow through the pile of the carpet to bend the tufts toward the slot. However, it must also be small enough to insure that the air flow is principally through the pile. The gap is typically set from $\frac{1}{3}$ to $\frac{7}{8}$ the carpet thickness, and best results have been achieved in the range of one quarter to five eights inches.

Figure 4:
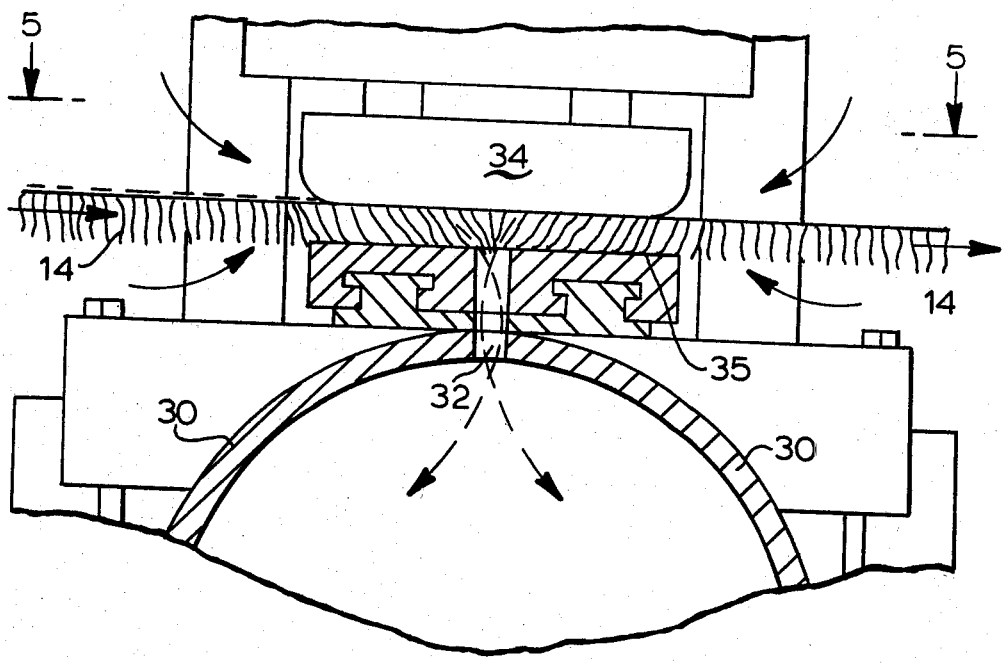
FIG. 4 is a sectional elevation view of the suction assembly within the system.
Figure 5:
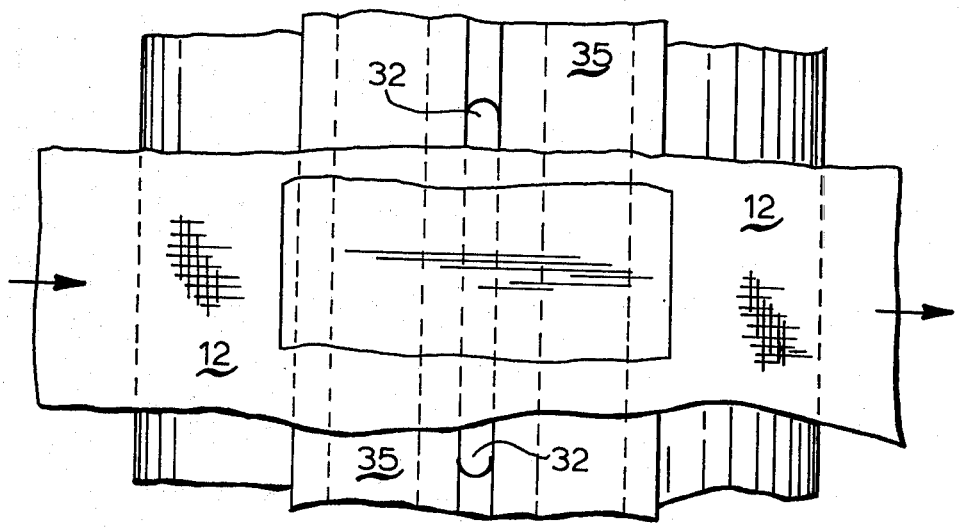
FIG. 5 is a plan view showing the fabric passing over a slotted suction pipe.

The gap length is the distance through which the carpet is subjected to the vacuum cleaning process. This length is extened considerably through the use of the floating backup plate 34, and cleaning begins almost as soon as the carpet enters the gap. The vacuum causes gum to move to the tips of the tufts where it can be removed as said tips enter the slot. The tips remain in the slot for a period of time which is greater than the time the roots of the tufts spend over the slot. This is because: (1) the lengths of the tufts are greater than the gap between the backup device and slot face and (2) the tufts bend toward the slot as shown in FIG. 4. The point at which the tips leave the slot area may be used to define the gap length. Copending application Ser. No. 29,540, filed Apr. 12, 1979, explains the cleaning process in further detail.

The carpet moves through the washing system 10 and to the diffuser 28 in such a manner that normal operating tensions keep the back of the carpet against the backup plate 34. This also prevents the vacuum in the slot from pulling the carpet partially therein as in a standard vacuum extractor. The parameters of the suitable slot must fit the configuration of the backup plate so as to control the length and size of the gap.

The prolix diffuser assembly 28 includes a slide plate 36 which is able to move up or down with respect to the carpet. An adjustable screw assembly 38 including a handwheel 40, handle 42, and screw 44 is used to position the slide plate 36 and backup plate 34 for each type of fabric. Cam followers or rollers 46 are provided within the frame for allowing the plate 34 to float over the carpet. An indicator means 47 including a pointer 48 is provided for setting the proper gap.

The carpet passes from the diffuser assembly to an idler roll 49 where it is again wetted by a shower 50. The shower 50 and roll 49 operate in about the same manner as the shower 25 and idler roll 18 described above. The second idler roll 49 is included within an adjustable frame assembly 52 having a nut and screw adjustment means 54. By employing the adjustment, the roll 49 may be positioned at the desired height.

The water extraction and cleaning process is repeated by a second prolix diffuser assembly 28. This assembly is identical with the one described above, and the same numerals are used to identify the same parts within the drawings.

From the second diffuser assembly, the carpet proceeds to an idler roll 56, pin drive roll 58, and an idler roll 60, respectively. A pan assembly 62 with a drain is provided beneath the diffuser assemblies 28 for collecting water which may overflow or drain from the system.

Figure 3:
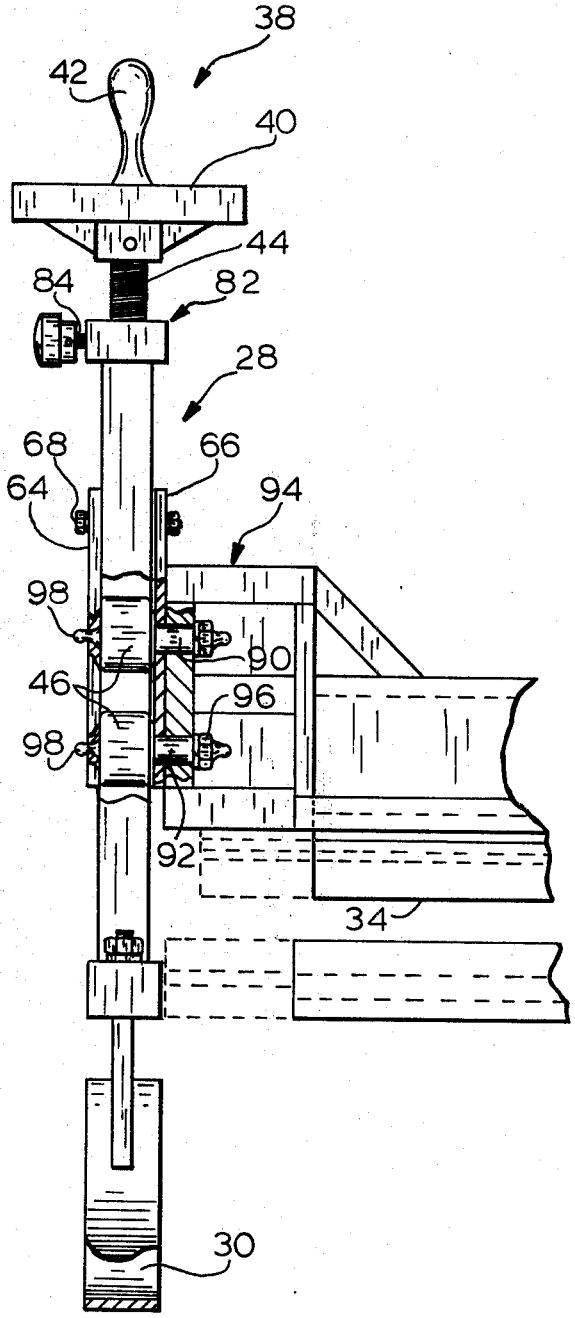
FIG. 3 is a side elevation view of the assembly shown in FIG. 2.

The diffuser assembly 28 is shown in greater detail in FIGS. 2 and 3. The slide plate 36 includes two pairs of flat parallel members 64, 66 secured to each other by a plurality of nut and bolt assemblies 68. Another flat plate member 70 is positioned between parallel members 64, 66. The nut and bolt assemblies 68 also extend through this middle plate 70, thereby securing it to the parallel members 64, 66. As shown in the Figures, the middle plate 70 has a greater height than either of the parallel members, but the latter extend further laterally. Accordingly, the lateral edges of the slide plate 36, which comprises members 64, 66 and 70, are U-shaped when viewed from the top of the assembly 28.

The middle plate 70 includes a rectangular slot 72 in the center portion thereof. Each of the parallel members 64, 66 extend over part of the slot so as to define a pair of opposing U-shaped grooves in the central portion of the slide plate 36. The rollers 46 fit within the grooves and are capable of vertical movement therein. The lower portion 74 of the slot is rounded into the shape of one of the rollers so that it can nest against it.

The lateral edges of the slide plate 36 are formed such that the distance between each pair of parallel members 64, 66 is slightly greater than the thickness of the assembly frame 76. The plate 36 is accordingly slidable upon the frame 76 as the vertical beams 78 thereof serve as tracks for the U-shaped edges.

The threaded shaft 44 of assembly 38 extends through a threaded bore in the upper horizontal beam 80 of the assembly frame 76. A locking mechanism 82 is provided at this point including a locking screw 84. The lower portion of the shaft 44 extends through the upper transverse member 86 of the slide plate 36. A bolt 88 secures it to said plate 36.

As shown in FIG. 3, each roller 46 has a shaft 90,92 extending therefrom. The shafts 90,92 extending into a framework 94 are secured thereto by bolts 96. The framework 94 supports the backup plate 34. Grease fittings 98 are provided wherever appropriate to insure a smooth operation and to decrease wear.

In operation, the carpet is wetted with hot water from the first shower nozzle 25. Water jets are directed into the nip between the roll 18 and the carpet 12 and puddles through the carpet. The water reduces the gum viscosity and particularly when applied to the back 14, washes the gum towards the tips of the tufts.

The air flows through the face of the carpet in the gap towards the vacuum slot. With the proper gap dimensions, the tufts are bent so that the tips are pointed downstream towards the slot. The air flow tends to further bring the gum toward the tip of the tuft.

The tip of the tuft enters the vacuum slot due to its downstream deflection before the root of the tuft is opposite the slot. Air flow keeps each individual tuft in the slot until its root has passed thereover and downstream a sufficient distance to physically pull the tuft out of the slot. The time each tuft spends in the slot is accordingly greater than in a standard vacuum slot, and allows the air flow to more effectively remove the gums concentrated towards the tip of the tuft by the previous hot water wash.

The indirect path taken by the air as it travels around the plate and through the pile, coupled with its relatively high velocity, promote the dewatering operation. It has been found that the use of a backup device with the suction pipe reduces the air flow requirements on unbacked carpet by a factor of approximately 2:1. The energy demands of the system are accordingly smaller.

The diffuser assembly 28 is advantageously adapted for the drying of carpet. The desired minimum gap is set by adjusting the screw mechanism 38. By turning wheel 40, the slide plate 36 moves up or down within the frame 76. Rollers 46 will also move up or down with the plate 36 as the lower roller is nested within the slot portion 74. The backup plate 34 moves with the rollers. After a desired initial setting of the gap between the backup plate 34 and the surfaces 35 defining the suction slot is made, the locking mechanism 82 is utilized to insure the setting does not change. In the disclosed embodiment, both the backup plate 34 and the slot face 35 have planar surfaces.

As carpet passes through the gap during the drying operation, the actual gap between the backup plate 34 and slot face 35 is dependent not only upon the initial setting, but upon the tension of the carpet and the weight of the backup plate. As explained above, the backup plate "floats" upon the carpet and will bounce over seams or any other irregularities. The initial gap setting which is accomplished with the screw assembly 38 provides a minimum gap. The plate is, however, capable of upward movement independent of the movement of the slide plate 36. The tension on the carpet will tend to push the plate (and rollers 46) upwardly while gravity urges the plate down. An equilibrium position is accordingly reached.

The provision of at least two rollers 46 within the slide plate insures that the framework 94 and backup plate 34 moves smoothly and evenly with respect to the slot face 35.

The entire washing and drying process is repeated as a second shower nozzle, idler roll, and diffuser are employed. A thorough cleaning and drying operation is thereby provided.

As the carpet leaves the slot in either of the two diffuser assemblies, the air flow through the pile towards the slot (which is now upstream) may add incremental improvement in the washing.

Alternative means may be employed for deflecting the tufts toward the vacuum slot. A porous conveyor belt moving faster than the carpet and between the carpet face and slot could serve this function.

Those skilled in the art will appreciate that modifications can be made in the system described above without departing from the spirit of the invention. Single or multiple slotted suction pipes may be utilized and the operating parameters can be changed depending upon the fabric to be treated. The scope of the invention should accordingly be determined by reference to the appended claims.

What is claimed is:

1. A system for cleaning and drying porous fabrics, comprising:

means for passing a porous fabric having a face side and a back side in a downstream direction and at an appropriate speed;

means for applying a liquid to said fabric;

means for applying suction to one side of said fabric positioned downstream from said means for applying liquid;

backup means positioned opposite said means for applying suction such that said fabric will pass in a gap between said backup means and said means for applying suction, said backup means preventing air from flowing directly through said fabric and causing it to flow along an indirect route; and means for mounting said backup means opposite said means for applying suction, said mounting means including means for allowing said backup means to float upon a fabric as it passes thereunder, said backup means being at least capable of movement in a direction opposite said means for applying suction as it floats upon said fabric to increase the size of the gap.

2. A system as described in claim 1 wherein said mounting means includes means for setting a minimum gap between said backup means and said means for applying suction.

3. A system for cleaning and drying porous fabrics, comprising:

means for passing a porous fabric having a face side and a back side in a downstream direction and at an appropriate speed;

means for applying a liquid to said fabric;

means for applying suction to one side of said fabric positioned downstream from said means for applying liquid;

backup means positioned opposite said means for applying suction such that said fabric will pass in a gap between said backup means and said means for applying suction, said backup means preventing air from flowing directly through said fabric and causing it to flow along an indirect route; and means for mounting said backup means opposite said means for applying suction, said mounting means including an assembly frame, a first slidable assembly mounted within said assembly frame and slidable with respect thereto, a second slidable assembly mounted within said assembly frame, said second slidable assembly being slidable with respect to said first slidable assembly, said backup means being secured to said second slidable assembly and movable therewith such that it can float upon a fabric passing thereunder, said backup means being movable in a direction opposite said means for applying suction as it floats upon said fabric to increase the size of the gap.

4. A system as described in claim 3 wherein said first slidable assembly includes a slot therein, said second slidable assembly including at least one roller being positioned within said slot and movable within said slot, said backup means being secured to said roller and movable therewith.

5. A system as described in claim 4 wherein said first slidable assembly is secured to said assembly frame by means of an adjustable screw assembly, said first slidable assembly being movable with respect to said assembly frame upon rotation of said screw assembly.

6. A system as described in claim 4 wherein means are provided within said slot for limiting the movement of the roller therein.

7. An apparatus for extracting liquid from a porous fabric, comprising:

a vacuum source;

backup means positioned opposite said vacuum source such that a gap exists between said vacuum source and said backup means, through which a fabric may pass;

an adjusting means for setting the minimum size of the gap between the vacuum source and the backup means, and means for mounting said backup means, said mounting means including means for allowing said backup means to move in a direction away from said vacuum source, thereby increasing the size of the gap, when a sufficient force in said direction is applied thereto such that said backup means will float upon a fabric passing through said gap.

8. An apparatus for extracting liquid from a porous fabric, comprising:

a vacuum source;

backup means positioned opposite said vacuum source such that a gap exists between said vacuum source and said backup means, through which a fabric may pass;

adjusting means for setting the minimum size of the gap between the vacuum source and the backup means; and means for mounting said backup means, said mounting means including an assembly frame, said adjusting means being secured to said assembly frame and slidable with respect thereto, said backup means being secured to said adjusting means and slidable with respect thereto such that it can move in a direction away from said vacuum source, thereby increasing the size of the gap, when a sufficient force is applied in said direction whereby said backup means will float upon a fabric passing through said gap.

9. An apparatus as described in claim 8 wherein said adjusting means is a slide plate slidably mounted to said assembly frame, said slide plate having a slot therein; at least one roller positioned within said slot and slidable therein, said backup means being secured to said roller and movable therewith.

10. An apparatus as described in claim 9 wherein said slide plate is secured to said assembly frame by an adjustable screw assembly, wherein said slide plate is capable of sliding within said assembly frame by rotation of said screw assembly.

11. An apparatus as described in claim 9 wherein a plurality of rollers are provided within said slot, said backup means being secured to each of said rollers.

12. An apparatus as described in claim 9 wherein said slot is formed so as to limit the range of movement of said roller.

13. A system as described in claim 1 wherein said backup means is a non-porous plate secured to said mounting means such that it is restricted from moving along a path travelled by a fabric passing thereunder through said gap.

14. A system as described in claim 7 wherein said backup means is a non-porous plate secured to said mounting means such that it is restricted from moving along a path travelled by a fabric passing thereunder through said gap.

* * * * *